US009493978B2

(12) United States Patent
Welyki

(10) Patent No.: US 9,493,978 B2
(45) Date of Patent: Nov. 15, 2016

(54) AUXILIARY WINDOW PANE SYSTEM

(71) Applicant: Roger Welyki, Nolalu (CA)

(72) Inventor: Roger Welyki, Nolalu (CA)

( * ) Notice: Subject to any disclaimer, the term of this patent is extended or adjusted under 35 U.S.C. 154(b) by 139 days.

(21) Appl. No.: 14/597,751

(22) Filed: Jan. 15, 2015

(65) Prior Publication Data

US 2015/0197978 A1 Jul. 16, 2015

Related U.S. Application Data

(60) Provisional application No. 61/927,665, filed on Jan. 15, 2014.

(51) Int. Cl.

| | |
|---|---|
| ***E04F 21/00*** | (2006.01) |
| ***E06B 3/54*** | (2006.01) |
| ***E06B 3/56*** | (2006.01) |
| ***E06B 7/28*** | (2006.01) |
| ***E06B 3/28*** | (2006.01) |

(52) U.S. Cl.

CPC ..... *E06B 3/5418* (2013.01); *E04F 21/0007* (2013.01); *E06B 3/28* (2013.01); *E06B 3/5481* (2013.01); *E06B 3/56* (2013.01); *E06B 7/28* (2013.01)

(58) Field of Classification Search

CPC ..... E04F 21/0007

USPC ..... 33/194, 197, 613, 645

See application file for complete search history.

(56) References Cited

U.S. PATENT DOCUMENTS

| | | | | |
|---|---|---|---|---|
| 4,194,331 | A | 3/1980 | Gingle et al. | |
| 5,123,172 | A * | 6/1992 | Thrun | E04F 21/00 269/905 |
| 2003/0131486 | A1* | 7/2003 | Wallace | B25H 7/00 33/194 |
| 2003/0204961 | A1* | 11/2003 | Sumner | E04F 21/0015 33/194 |
| 2004/0250436 | A1* | 12/2004 | McAdam | B21D 5/042 33/534 |
| 2005/0022397 | A1* | 2/2005 | Neblo | E04F 21/003 33/194 |
| 2006/0048398 | A1* | 3/2006 | Militello | E06B 9/266 33/194 |
| 2014/0182154 | A1* | 7/2014 | Tommy | E04F 21/0007 33/533 |
| 2016/0209198 | A1* | 7/2016 | Badhya | G01B 5/06 33/833 |

* cited by examiner

*Primary Examiner* — G. Bradley Bennett

(74) *Attorney, Agent, or Firm* — Ryan W. Dupuis; Kyle R. Satterthwaite; Ade & Company Inc.

(57) ABSTRACT

An auxiliary pane is attached to a window having an existing primary window pane using a plurality of mounting members, each formed of a first flange and a second flange joined perpendicularly to one another at an apex so as to be substantially L-shaped. The first flange of each mounting member is secured to an inner frame surface of the perimeter frame of the window using a curable adhesive material. A gauge having first and second gauge surfaces at a prescribed distance is used to align the second flanges of the mounting members into a common plane by abutting the first gauge surface against the primary window pane and adjusting each mounting member to abut the second flange thereof to the second gauge surface of the gauge before the curable adhesive material has cured. Once cured, the auxiliary pane is magnetically coupled to the second flanges of the mounting members.

14 Claims, 2 Drawing Sheets

AUXILIARY WINDOW PANE SYSTEM

This application claims the benefit under 35 U.S.C.119(e) of U.S. provisional application Ser. No. 61/927,665, filed Jan. 15, 2014.

FIELD OF THE INVENTION

The present invention relates to a method of improving the insulating qualities of windows by magnetically attaching an auxiliary pane to a perimeter frame of a window assembly, and more particularly the present invention relates to a gauge for use in aligning the auxiliary pane relative to an existing pane of the window assembly.

BACKGROUND

It is generally known in colder climates that the insulating properties of window assemblies can be enhanced by providing more panes of glass with the panes being separated by an enclosed space. In addition to the construction of dual and triple pane windows, it is further known that providing additional panes of transparent plastic such as acrylic further enhances the insulation properties of the window assembly.

U.S. Pat. No. 4,194,331 by Gingle et al discloses one example of a window assembly in which an auxiliary pane is selectively attached to an existing pane of an existing window assembly so as to permit ready separation in warmer seasons and the like. A magnetic mounting strip is secured adhesively directly to the existing pane of glass such that a perimeter edge of the auxiliary pane can be magnetically coupled thereto when provided with its own magnetic mounting strip at the perimeter thereof. In this instance, the auxiliary pane must be very carefully cut with close tolerance to fit within the perimeter frame about the existing pane of the window assembly, otherwise a perimeter gap will result which permits leakage of heat therethrough and has an unpleasant and unfinished appearance. Accordingly an additional trim piece is required to be subsequently attached about the perimeter of the auxiliary pane to enclose the gap.

To overcome the disadvantages described above with regard to Gingle et al, it is also generally known in the prior art to make use of an L-shaped mounting member having a first flange fastened with screws to a surface of the perimeter frame which projects perpendicularly to the existing pane of the window assembly. The second flange of the mounting member is intended to lie substantially parallel to the existing pane of the window assembly about the perimeter of the existing plane to provide a mounting surface relative to which the auxiliary pane can be magnetically coupled. As the first flange is fastened directly to the perimeter frame of the window assembly, there is no problem with regard to a perimeter gap as in the prior art by Gingle et at; however, in this instance the perimeter frame of the existing window is relied on for positioning of the mounting surface relative to which the auxiliary pane is magnetically coupled. In practice, the resulting mounting surface about the perimeter of the window frame when fastening the first flange to the perimeter frame because the fasteners tend to distort the shape of the mounting members as they are penetrated therein, and because the existing window frame used for aligning the mounting member is rarely true and planar about the full perimeter thereof due to warping and the like. Accordingly, the magnetic mounting strip about the perimeter of the auxiliary pane commonly does not make sufficient contact with mounting surface defined by the mounting members about the perimeter of the window frame, resulting in failure of the auxiliary panes to remain properly attached in many instances.

SUMMARY OF THE INVENTION

According to one aspect of the present invention there is provided a gauge for use in aligning a mounting flange of an auxiliary pane on a perimeter frame of a window assembly at a prescribed distance relative to a primary window pane of the window assembly in which the auxiliary pane is arranged to be magnetically coupled to the mounting flange, the gauge comprising:

- a rail extending in a longitudinal direction;
- a first gauge element fixed relative to the rail which includes a first gauge surface defining a first contact plane which is perpendicular to the longitudinal direction at one end of the rail so as to be arranged for abutment against the primary window pane;
- a second gauge element which is slidably adjustable along the rail which includes a second gauge surface which defines a second contact plane parallel to the first gauge surface so as to be arranged for abutment against the mounting flange at any location about a full perimeter of the perimeter frame of the window assembly; and
- a locking element arranged to selective fix the second gauge element relative to the rail with the second gauge surface at said prescribed distance relative to the first gauge surface.

Preferably each of the first and second gauge surfaces comprise a flat, planar surface.

According to a second aspect of the present invention there is provided a method of attaching an auxiliary pane to a window assembly having a primary window pane and a perimeter frame about a full perimeter of the primary window pane, the perimeter frame including a frame surface oriented perpendicularly to the primary window pane about the full perimeter of the primary window pane, the method comprising:

- providing a plurality of mounting members, each comprising a first flange and a second flange joined perpendicularly to one another at an apex so as to be substantially L-shaped along a length of the mounting member;
- securing the first flange of one of the mounting members to the frame surface of the perimeter frame along each side of the perimeter frame using a curable adhesive material;
- providing a gauge comprising a first gauge surface and a second gauge surface arranged to be fixed relative to the first gauge surface at a prescribed distance;
- abutting the first gauge surface of the gauge against the primary window pane;
- before the curable adhesive material has cured, for each mounting member about the full perimeter of the perimeter frame, adjusting the position of the first flange relative to the frame surface of the perimeter frame until the second flange abuts the second gauge surface while the first gauge surface abuts the primary window pane; and
- magnetically coupling a perimeter edge of the auxiliary pane to the second flanges of the mounting members.

The use of the gauge tool as described herein together with a curable adhesive permits the mounting surface of the mounting member to be referenced to the common planar reference surface of the existing window pane about a full perimeter thereof and permits adjustment of the mounting surfaces of the mounting members before the adhesive cures to correct any misalignments located by the gauge tool. The curing of the adhesive does not distort the mounting surfaces of the mounting members once aligned using the gauge tool. The resulting mounting surface once the adhesive is cured is thus truly parallel to the common reference plane defined by the existing pane of glass. In this instance, the auxiliary pane makes a strong magnetic contact with the mounting surface of the mounting member about the full perimeter of the window assembly so as to minimize any failure in the mounting of the auxiliary pane to the existing pane.

Although auxiliary window panes mounted using other techniques have not been found to greatly affect the air leakage of an existing window to the resulting misalignments of the mounting members, air leakage testing of the resulting window assembly which includes an auxiliary window pane supported thereon according to the present invention has been found to greatly decrease air leakage rates. In one instance, where a single slider window unit having an average leak rate at 75 Pa of 0.30 L/s $M^2$, the mounting of an auxiliary pane according to the present invention was found to reduce air leakage to 0.01 L/s $m^2$ when tested at the same 75 Pa pressure level.

Preferably the mounting members are secured to the perimeter frame only using the curable adhesive material which remains resilient once cured, for example silicone of the type which is dispensed from a tube.

Preferably mounting members are formed of a single sheet of material folded to define a first flange portion spanning from the apex to a free end of the first flange, a first auxiliary portion spanning from the free end of the first flange at least half way towards the apex alongside the first flange portion, a second flange portion spanning from the apex to a free end of the second flange, and a second auxiliary portion spanning from the free end of the second flange at least half way towards the apex alongside the second flange portion.

Preferably the prescribed distance of the second gauge surface relative to the first gauge surface is adjusted by abutting the second gauge surface with the second flange of a first selected one of the mounting members while abutting the first gauge surface of the gauge against the primary window pane.

Preferably the gauge comprises a rail extending in a longitudinal direction, a first gauge element fixed relative to the rail and defining the first gauge surface perpendicularly to the longitudinal direction at one end of the rail, and a second gauge element defining the second gauge surface parallel to the first gauge surface, wherein the second gauge element is adjustable in the longitudinal direction along the rail.

Preferably the gauge further includes a locking element on the second gauge element and the method includes using the locking element to fix the second gauge element relative to the rail with the second gauge surface at said prescribed distance relative to the first gauge surface.

The method preferably includes, for each mounting member, adjusting the mounting member while sliding the first gauge surface alongside the mounting member such that the second flange of the mounting member remains in sliding contact with the second gauge surface while the first gauge surface remains in sliding contact with the primary pane.

One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
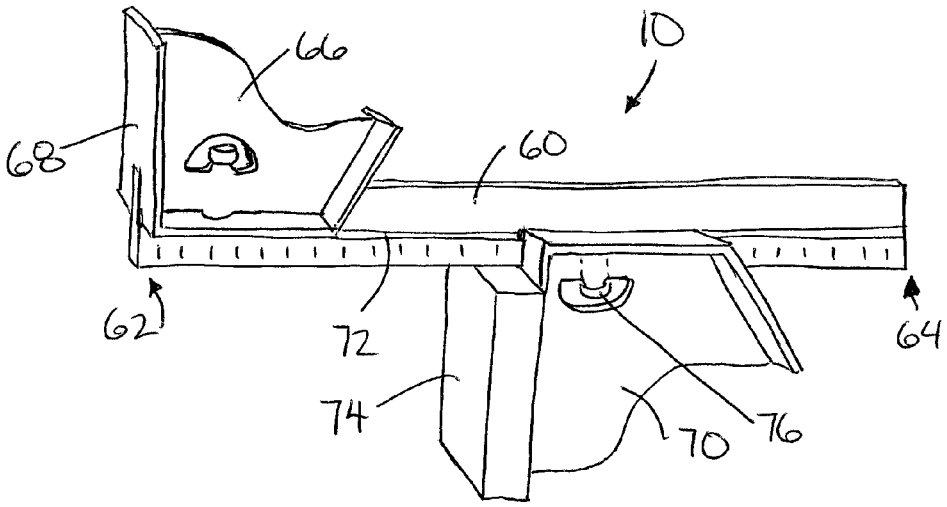
FIG. 1 is perspective view of the auxiliary window pane installation gauge.
Figure 2:
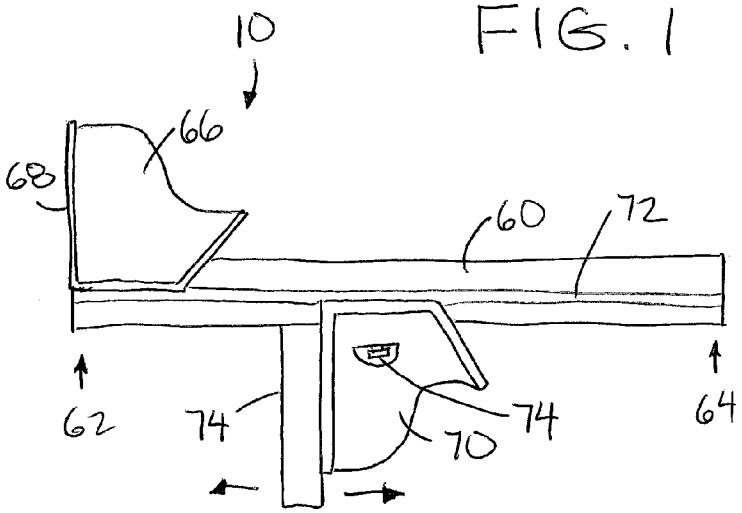
FIG. 2 is a side elevational view of the gauge.
Figure 3:
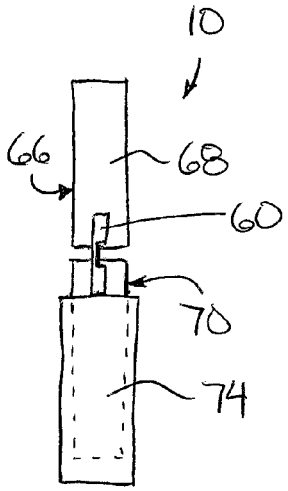
FIG. 3 is an end elevational view of the gauge.
Figure 5:
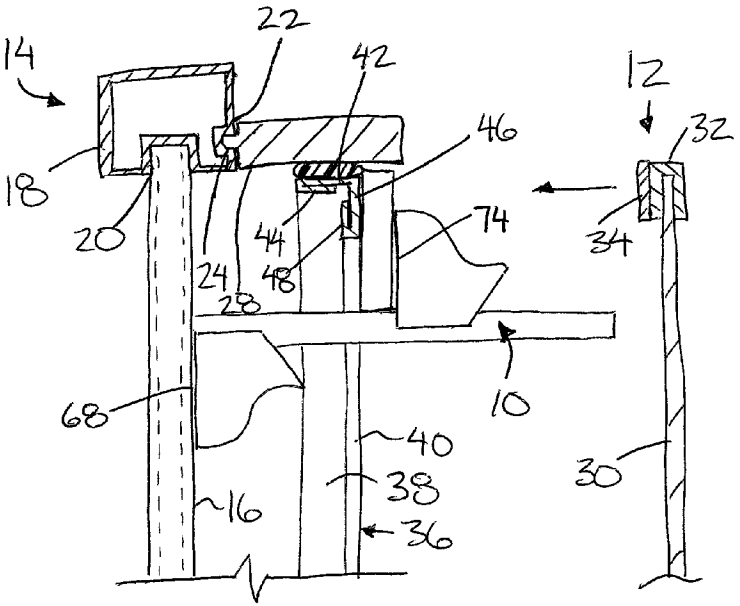
FIG. 5 is a cross sectional view of the mounting members being installed on the window assembly of FIG. 4 using the gauge according to FIG. 1.
Figure 6:
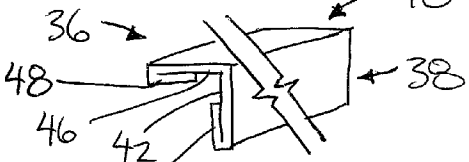
FIG. 6 is a perspective view of one of the mounting members.
Figure 4:
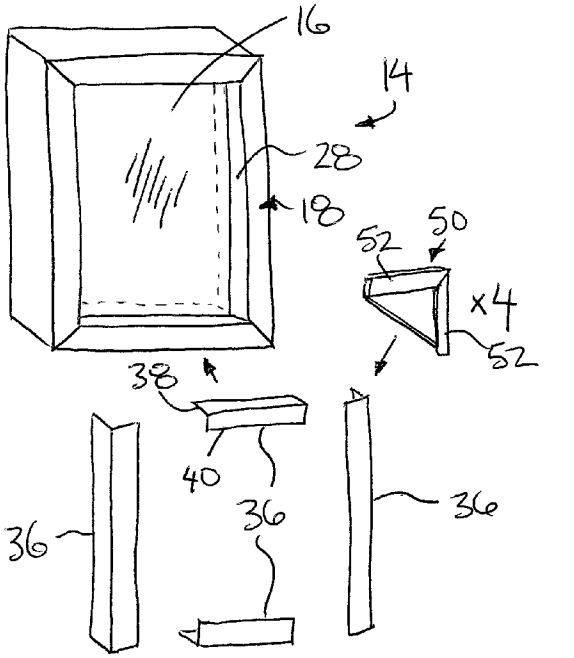
FIG. 4 is an exploded view of a window assembly including an auxiliary pane according to the present invention.
Figure 4:
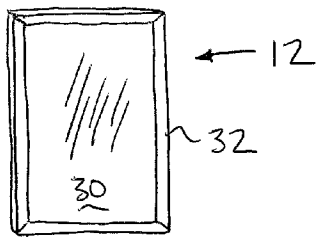

Referring to the accompanying figures, there is illustrated a gauge tool generally indicated by reference numeral 10. The tool 10 is particularly suited for use in installation of an auxiliary pane 12 within a window assembly 14.

A typical window assembly to which the auxiliary pane 12 is applied generally comprises one or more existing panes 16, usually provided as a dual or triple pane sealed unit, mounted within a perimeter frame 18. The perimeter frame 18 is provided about the full perimeter of the sealed unit of existing panes 16. The frame may be wood, pvc, or metal and the like.

In the illustrated embodiment, the perimeter frame comprises a plastic extrusion, for example PVC, which is generally formed of frame members connected in series about the perimeter of the panes 16 so that each frame member spans a respective side of the window assembly. Each frame member is a hollow extruded member of generally rectangular form which includes a first channel 20 recessed into the inner side facing inwardly for receiving the edges of the respective sealed unit of window panes therein.

The frame members of the perimeter frame further include a second channel 22 at the front side. The front sides of the frame members about the full perimeter face to the interior side of the building are aligned with one another so as to lie generally in a common plane about the full perimeter. The second channel 22 is a recessed groove of suitable profile for mating connection with a snap connector 24 of a drywall return member 26.

The drywall return member 26 or other suitable finishing extension of the frame members of the perimeter frame of the window assembly defines a frame surface 28 projecting perpendicularly outward from the planes of the panes 16 along all sides of the perimeter such that the frame surfaces face inwardly towards a center of a window assembly.

The auxiliary pane 12 comprises a flat sheet of clear acrylic material which is trimmed about the perimeter thereof to be near in size to the interior dimensions of the perimeter frame 18 at the location of the frame surfaces 28. In addition to the clear sheet 30, the auxiliary pane 12 further includes a mounting frame 32 about the full perimeter edge thereof. The mounting frame includes a magnetic element 34 at the rear side thereof such that all of the magnetic elements thereof lie in a common rear plane. The front surface of the mounting frame has a finished surface such as a powder coated finish or a smooth plastic finish for example.

The mounting frame of the auxiliary pane 12 is secured to the perimeter frame of the window assembly using a plurality of mounting members 36. One mounting member is provided to span substantially the full length of each side of the polygonal perimeter of the perimeter frame 18 of the window assembly. Accordingly, in the illustrated embodiment of a rectangular window, four mounting members are provided which collectively span the full perimeter of the frame.

Each mounting member 36 is formed of a flat sheet of powder coated steel having ferromagnetic properties, which is folded into the finished shape of the mounting member defining a first flange 38 and a second flange 40 which are joined at a 90 degree angle relative to one another along respective edges so as to meet at an apex and define a generally L-shaped cross section.

The flat sheet of material is folded to form a first flange portion 42 which spans from the apex to a free end of the first flange 38 and a first auxiliary portion 44 which is folded back along the inner side of the first flange portion to project from the free end of the first flange 38 at least half of the distance back towards the apex.

The sheet is further folded to define the apex by forming a second flange portion 46 extending from the first flange portion 42, perpendicularly thereto so that the apex is defined at the intersection thereof. The second flange portion extends from the apex at the intersection with the first flange portion towards the free end of the second flange 40.

A second auxiliary portion 48 is then folded back along the inner surface of the second flange portion 36 to extend from the free end of the second flange at least half of the distance back towards the apex. In this manner, the first flange portion 42 and the first auxiliary portion 44 collectively define the first flange 38 while the second flange portion 46 and the second auxiliary portion 48 collectively define the second flange 40.

The mounting members are secured to the perimeter frame of the window assembly specifically by securing the outer surface of the first flange 38 to the frame surface 28 at the respective side of the perimeter frame so as to be oriented perpendicularly to the existing panes 16. The mounting members are oriented such that the second flange is located at the edge of the first flange which is farthest from the existing panes.

The first flange is secured to the frame surface using a pure silicone rubber compound dispensed from a caulking tube between the first flange of the mounting member and the frame surface. The adhesive compound remains adjustable until it cures such that the depth of the second flange from the existing panes 16 of the window remains adjustable upon initial installation.

Typically, all of the second flanges of the mounting members are arranged to be set at a prescribed distance from the inner most existing pane 16 along the full length of each member and thus about a full perimeter of the frame. This is accomplished by typically setting the gauge tool to the prescribed distance. The tool can then be abutted against the innermost existing pane 16. The tool is used to transfer the prescribed distance from the existing pane to the second flange of the mounting member such that the position of the second flange can be adjusted if the gauge indicates that it is not at the prescribed distance, prior to curing of the adhesive compound.

Once the frame members have been properly aligned about the full perimeter, no other fastening means are employed to mount the mounting members relative to the perimeter frame of the window assembly so as to not introduce any misalignments. While the adhesive cures, a plurality of corner guides 50 may be employed. Each corner guide comprises a triangular gusset of rigid material having a magnetic strip 52 along two right angle edges at a common side of the planar material. The two magnetic strips 52 are thus arranged to secure to two adjacent mounting members at their intersection at one of the corners of the perimeter frame.

The corner guides ensure that the adjacent mounting members remain oriented relative to one another with their respective second flanges in a common plane parallel to the innermost pane of glass. Once the adhesive material has cured, the corner guides can be removed and the auxiliary pane can instead be magnetically attached to the second flanges of the mounting members about the full perimeter.

The gauge tool 10 generally includes a rigid rail 60 which is elongate in a longitudinal direction between a first end 62 and a second end 64. A first guide element 66 is mounted at the first end of the rail in fixed relation therewith to define a first end surface 68 which is perpendicular to the longitudinal direction of the rail. The first end surface 68 is the outermost surface of the tool in the longitudinal direction such that the first end surface defines a first gauge surface which is suitable for abutting against the innermost pane 16 of the window assembly in parallel relation therewith. The first guide element and first end surface 68 thereof extends in a first lateral direction to be offset fully to one side relative to the longitudinal direction of the rail.

The tool further includes a second guide element 70 mounted on the rail for longitudinal sliding movement therealong in the longitudinal direction relative to the first guide element. The second guide element comprises a rigid body having a groove formed therein with a cross section that mates with a cross section of the rail, perpendicular to the longitudinal direction, such that the cooperating cross sectional shape of the rail and the groove 72 of the body of the second guide element retain the body of the guide element on the rail while permitting relative sliding therebetween in the longitudinal direction.

The second guide element 70 defines a second gauge surface 74 thereon which is parallel to the first gauge surface and which is longitudinally adjustable along the rail relative to the first gauge surface. The second gauge surface is movable between a first end of the rail in proximity to the first gauge surface and an opposing second end of the rail. Both of the first and second gauge surfaces face in a common longitudinal direction towards the first end of the tool and away from the second end such that the distance between the first and second gauge surfaces defines the prescribed distance that the tool gauges in the installation method described above.

The second gauge surface 74 on the body of the second guide element 70 extends fully in a second lateral direction opposite to the first lateral direction of the first gauge surface relative to the longitudinal direction of the rail such that the first and second gauge surfaces are offset in diametrically opposing directions relative to the longitudinal direction of the rail.

A locking element 76 is mounted on the body of the second guide element in the form of a set screw threadably retained within a respective threaded bore in the body of the section guide element. The set screw is oriented for selectively engaging the rail such that tightening the set screw fixes the second guide element relative to the rail and locks the gauge tool at a selected prescribed distance between the first and second gauged surfaces. Loosening the screw again permits longitudinal sliding of the second guide element relative to the first guide element.

To install an auxiliary pane 12 on an existing window assembly 14, the user initially provides a plurality of mounting members 36 cut to length such that one mounting member can span the full length of each of the sides of the polygonal shape of the perimeter frame of the window. Adhesive compound is dispensed from a tube along the first flange 38 of each mounting member for adhering the mounting member to a corresponding frame surface 28 oriented perpendicularly to the existing panes 16. All of the second flanges are oriented so as to be approximately in a common plane along the edges of the respective first flanges which are farthest from the existing panes.

Prior to the curing of the adhesive material, the gauge tool is used to ensure that all of the second flanges are at a common distance from the innermost existing pane of the window along the full length thereof and about the full perimeter of the window frame. This is accomplished by abutting the first end surface 68 defining the first gauge surface against the innermost surface of the existing panes 16. The second gauge surface 74 is then abutted with a selected portion of one of the second flanges of the mounting members to select the prescribed distance. The locking element is used to set the prescribed distance by fixing the second guide element relative to the rail and the first guide element.

The first gauge surface is then slidably displaced along the existing pane of the window assembly about the full perimeter of the perimeter frame of the window assembly. Meanwhile, the second gauge surface is abutted with the corresponding second flange along the full length thereof about the full perimeter. The second flange is pulled outwardly away from the existing panes or pushed inwardly towards the existing panes as required about the full perimeter until all of the second flanges have been confirmed to be at the common prescribed distance about the full perimeter of the frame.

The corner guides 50 are then attached at each of the corners of the perimeter frame to retain the levelled second flanges. No other fastening is performed between the mounting members and the perimeter frame of the window assembly to prevent any distortion of the common mounting plane of the second flanges 40 once set. Subsequent to curing of the adhesive, the corner guides can be removed. The true common plane of the second flanges then permits the auxiliary pane to be reliably secured by a magnetic coupling to the second flanges while remaining selectably separable as required or as desired seasonally for example.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A method of attaching an auxiliary pane to a window assembly having a primary window pane and a perimeter frame about a full perimeter of the primary window pane, the perimeter frame including a frame surface oriented perpendicularly to the primary window pane about the full perimeter of the primary window pane, the method comprising:

providing a plurality of mounting members, each comprising a first flange and a second flange joined perpendicularly to one another at an apex so as to be substantially L-shaped along a length of the mounting member;

securing the first flange of one of the mounting members to the frame surface of the perimeter frame along each side of the perimeter frame using a curable adhesive material;

providing a gauge comprising a first gauge surface and a second gauge surface arranged to be fixed relative to the first gauge surface at a prescribed distance;

abutting the first gauge surface of the gauge against the primary window pane;

before the curable adhesive material has cured, for each mounting member about the full perimeter of the perimeter frame, adjusting the position of the first flange relative to the frame surface of the perimeter frame until the second flange abuts the second gauge surface while the first gauge surface abuts the primary window pane; and magnetically coupling a perimeter edge of the auxiliary pane to the second flanges of the mounting members.

2. The method according to claim 1 including securing the mounting members to the perimeter frame only using the curable adhesive material.

3. The method according to claim 1 including using a curable adhesive material which remains resilient once cured.

4. The method according to claim 1 including using a curable adhesive material comprising silicone.

5. The method according to claim 1 including dispensing the curable adhesive material from a tube.

6. The method according to claim 1 including providing mounting members which are formed of a single sheet of material folded to define a first flange portion spanning from the apex to a free end of the first flange, a first auxiliary portion spanning from the free end of the first flange at least half way towards the apex alongside the first flange portion, a second flange portion spanning from the apex to a free end of the second flange, and a second auxiliary portion spanning from the free end of the second flange at least half way towards the apex alongside the second flange portion.

7. The method according to claim 1 including providing a gauge in which each of the first and second gauge surfaces comprise flat, planar surfaces and in which the first and second gauge surfaces are parallel to one another.

8. The method according to claim 1 including adjusting the prescribed distance of the second gauge surface relative to the first gauge surface by abutting the second gauge surface with the second flange of a first selected one of the mounting members while abutting the first gauge surface of the gauge against the primary window pane.

9. The method according to claim 1 including providing a gauge comprising a rail extending in a longitudinal direction, a first gauge element fixed relative to the rail and defining the first gauge surface perpendicularly to the longitudinal direction at one end of the rail, and a second gauge element defining the second gauge surface parallel to the first gauge surface, wherein the second gauge element is adjustable in the longitudinal direction along the rail.

10. The method according to claim 9 including providing the gauge with a locking element on the second gauge element and using the locking element to fix the second gauge element relative to the rail with the second gauge surface at said prescribed distance relative to the first gauge surface.

11. The method according to claim 1 including, for each mounting member, adjusting the mounting member while sliding the first gauge surface alongside the mounting member such that the second flange of the mounting member remains in sliding contact with the second gauge surface while the first gauge surface remains in sliding contact with the primary pane.

12. A gauge for use in aligning a mounting flange of an auxiliary pane on a perimeter frame of a window assembly at a prescribed distance relative to a primary window pane of the window assembly in which the auxiliary pane is arranged to be magnetically coupled to the mounting flange, the gauge comprising:

a rail extending in a longitudinal direction;

a first gauge element fixed relative to the rail which includes a first gauge surface defining a first contact plane which is perpendicular to the longitudinal direction at one end of the rail so as to be arranged for abutment against the primary window pane;

a second gauge element which is slidably adjustable along the rail which includes a second gauge surface which defines a second contact plane parallel to the first gauge surface so as to be arranged for abutment against the mounting flange at any location about a full perimeter of the perimeter frame of the window assembly; and a locking element arranged to selective fix the second gauge element relative to the rail with the second gauge surface at said prescribed distance relative to the first gauge surface.

13. The gauge according to claim 12 wherein the first gauge surface comprises a flat, planar surface.

14. The gauge according to claim 12 wherein the second gauge surface comprises a flat, planar surface.

* * * * *